United States Patent [19]

Salomon

[11] Patent Number: 4,769,164

[45] Date of Patent: Sep. 6, 1988

[54] ANTI-OXIDANT PRODUCTS

[75] Inventor: Mary F. Salomon, Cleveland Heights, Ohio

[73] Assignee: The Lubrizol Corporation, Wickliffe, Ohio

[21] Appl. No.: 53,933

[22] Filed: May 22, 1987

[51] Int. Cl.[4] ..... C10M 135/24

[52] U.S. Cl. ..... 252/48.2; 252/47; 252/48.4; 252/49.3; 252/77; 252/406; 252/407; 568/39; 568/45

[58] Field of Search ..... 252/48.2, 77, 49.3; 569/39, 45

[56] References Cited

U.S. PATENT DOCUMENTS

| | | | |
|---|---|---|---|
| 2,520,748 | 8/1950 | Vaughan et al. | 252/48.2 |
| 2,582,605 | 1/1952 | Richter et al. | 252/48.2 |
| 2,943,112 | 6/1960 | Popoff | 252/50 |
| 3,290,382 | 12/1966 | Hubscher et al. | 252/48.2 |
| 3,335,189 | 8/1967 | Degener et al. | 568/45 |
| 3,522,314 | 7/1970 | Warner | 568/39 |
| 4,123,372 | 10/1978 | Bridger et al. | 252/48.2 |
| 4,217,233 | 8/1980 | Michaelis | 252/48.2 |
| 4,250,046 | 2/1981 | Przyhylinski | 252/49.3 |
| 4,366,307 | 12/1982 | Singh | 568/45 |
| 4,486,322 | 12/1984 | Horodysky et al. | 252/48.2 |
| 4,551,259 | 11/1985 | Braid | 252/48.2 |
| 4,615,818 | 10/1986 | DiBiase et al. | 252/48.2 |

FOREIGN PATENT DOCUMENTS

| | | | |
|---|---|---|---|
| 496690 | 10/1953 | Canada | 252/48.2 |
| 647911 | 12/1950 | United Kingdom | 252/48.2 |

OTHER PUBLICATIONS

The Condensation of 2-Hydroxyethyl Sulfides with Alcohols and Phenols, Richter et al, Journal of Polymer Science, vol. XLI, pp. 4076–4079.

Thioglycol Polymers. I. Hydrochloric Acid-Catalyzed Autocondensation of Thiodiglycol, Woodward, Journal of Polymer Science, vol. XLI, pp. 219–223 (1959).

Thioglycol Polymers. III. Copolymerization of Thiodiglycol and Similar Thioglycols with Aliphatic Hydroxy Compounds, Andrews et al, Journal of Polymer Science, vol. XLI, pp. 231–239 (1959).

Nucleophilic Substitution of the Hydroxyl Groups of 2-Alkyl(Aryl) Thioethanols, Fokin et al, Bull. Acad. Sci. USSR Div. Chem. Sci., 1982, pp. 1667–1672 (1982).

*Primary Examiner*—William R. Dixon, Jr.
*Assistant Examiner*—Ellen McAvoy
*Attorney, Agent, or Firm*—Forrest L. Collins; Denis A. Polyn; James L. Cordek

[57] ABSTRACT

The use of aromatic amine or hindered phenols, and beta-thiodialkanol reaction products are described as being useful anti-oxidants.

37 Claims, No Drawings

ANTI-OXIDANT PRODUCTS

BACKGROUND OF THE INVENTION

1. Field of the Invention

It is desirable in various lubricating formulations to obtain materials which are stable in the lubricant and which impart antioxidant properties to the lubricating composition. The present invention deals with beta-dithioalkanol reaction products and aromatic amines or hindered phenols which are suitable in lubricating compositions.

2. Description of the Art

It is known from an article entitled *The Condensation of 2-Hydroxyethylsulfides with Alcohols and Phenols* by Richter et al, Journal of Polymer Science, Volume XLI, Pages 4076–4079, that a beta-dithiodialkanol when reacted in the presence of hydrochloric acid and an alcohol will give the corresponding ether as a reaction product. The technology in the Richter article is further reported in U.S. Pat. No. 2,582,605 issued Jan. 15, 1952.

It is suggested in German published patent application No. 1,520,040A that Guerbet alcohols may be condensed with thiodialkylols at a molar ratio of 1:0.5–0.9. U.S. Pat. No. 4,366,307 issued Dec. 28, 1982 to Singh et al describes non-crystallizing, water, solvent, fuel and temperature resistant liquid polythioethers having 2–4 terminating radicals and at least 8 repeating sulfur-containing units.

Further information with regard to the polymerization of a beta-thiodialkanol is found in *Thioglycol Polymers I Hydrochloric Acid-Catalyzed Auto Condensation of Thiodiglycol* by Woodward, Journal of Polymer Science, Volume XLI, Pages 219–223 (1959). The hydroxyl groups in the beta position relative to the sulfur in an aliphatic chain are stated to be of unusual reactivity in the Woodward article. Further information on such beta-dialkanols is found in *Thioglycol Polymers III Copolymerization of Thiodiglycol and Similar Thioglycols with Aliphatic Hydroxy Compounds* by Andrews et al, Journal of Polymer Science, Volume XLI, Pages 231–239 (1959). The Andrews' reference describes copolymers obtained from dihydroxy compounds where one of the compounds is thiodiglycol. Aromatic sulfur-containing compounds containing beta-hydroxy groups and their reaction properties are discussed in an article entitled *Nucleophilic Substitution of Hydroxyl Groups in 2-Alkyl (Aryl)-Thioethanols* by Fokin et al., Bull. Acad. Sci. U.S.S.R. Div. Chem. Sci. 1982, Pages 1667–1672 (1982).

U.S. Pat. No. 2,943,112 to Popoff et al issued June 28, 1960, describes the preparation of diphenylamine compounds. Popoff et al also states that the diphenylamine compounds are useful as anti-oxidants in rubber compositions.

It has, however, now been discovered that products having exceptional anti-oxidant properties may be obtained through mixtures of an aromatic amine such as an alkylated diphenylamine and the reaction product of a monohydric alcohol and a beta-thiodialkanol. The subject compositions are particularly suited for automobile automatic transmission fluids.

Throughout the specification and claims, percentages and ratios are by weight, temperatures are in degrees Celsius and pressures are in KPa gauge unless otherwise indicated. To the extent that any of the references cited in this application are relevant to the present invention, they are herein incorporated by reference.

SUMMARY OF THE INVENTION

This invention describes an oil-soluble composition of: (A) the reaction product of a beta-thiodialkanol and a monohydric alcohol wherein the beta-thiodialkanol is terminated with the residue of the monohydric alcohol; and (B) an aromatic amine or a hindered phenol.

A further feature of the invention is a composition which is: (A) the hydrocarbyl terminated reaction product of a beta-thiodialkanol of the formula $$HOR^1(S)_xR^2OH \qquad \text{I}$$

terminated with a monohydric alcohol of the formula $$ROH \qquad \text{II}$$

wherein X is an integer of 1 or greater; $R^1$ and $R^2$ are each —$CHR^3CHR^4$— radicals where $R^3$ and $R^4$ are hydrogen or hydrocarbyl; R is a hydrocarbyl radical and the reaction is conducted such that the molar ratio of I:II in the reaction product is about 7:2 to about 1:2, and (B) an aromatic amine or hindered phenol or mixtures thereof.

DETAILED DESCRIPTION OF THE INVENTION

The products of the present invention are obtained by first reacting a beta-thiodialkanol with an alcohol of Formula II. That is, the capping is done at both ends of the beta-thiodialkanol by using two moles of the alcohol. The beta-thiodialkanol may be the monomer or a polymeric form $$HO[R^1(S)_xR^2O]_yR^1(S)_xR^2OH \qquad \text{III}$$

where y is conveniently 0 to 7, preferably 1 to 3 or mixtures of the monomer and polymer.

Variations are also possible in the preparation of the compositions of the present invention such as by introducing limited quantities of the alcohol of the Formula II and polymerizing the beta-thiodialkanol monomer onto the alcohol (II) and then capping that reaction product with another mole of the monohydric alcohol. The preferred method, however, is that of reacting the beta-thiodialkanol and the monohydric alcohol simultaneously in the same pot.

The reaction is typically conducted in the presence of a catalytic amount of hydrochloric, sulfuric, phosphoric or para toluene sulfonic acids. The catalyst level is typically at 0.5–3% by weight of the beta-thiodialkanol and the temperature is about 50°–200° C. A further discussion of the preparation of such beta-thiodialkanols is found in the Woodward article previously incorporated by reference. Conveniently, an inert solvent such as toluene is utilized under refluxing conditions with continuous removal of the water of reaction.

The reaction is conveniently conducted until no more water is formed. Water is evolved from both the polymerization and capping reactions. Typically, the time period will be about 2 to about 10 hours to complete the reaction. At that time, the catalyst is neutralized with sodium hydroxide or other suitable base. The solvent is then removed under reduced pressure and residue is filtered. The filtrate yield will vary between 70% and 100% depending upon the individual reaction conditions.

The beta-thiodialkanol as previously described of the formula $HOR^1(S)_xR^2OH$ (I) allows substantially any group of substituents between the hydroxyl group and the sulfur provided that two carbon atoms intervene between the sulfur and the oxygen.

In a preferred state, $R^1$ and $R^2$ are each —$CHR^3CHR^4$—. Where both $R^3$ and $R^4$ are hydrogen, an ethylene group exists. Of course, $R^3$ and $R^4$ may be any non-interfering hydrocarbyl group. A hydrocarbyl group as defined herein is a moiety containing hydrogen and carbon and any other non-interfering atoms. Preferably $R^3$ or $R^4$ are limited to hydrogen or lower straight chain alkyl groups such as methyl or ethyl. It is noted, that if a t-butyl group is inserted in the molecule as $R^3$ or $R^4$, the condensation reaction to form the polymer is particularly hindered. However, a styrene residue is non-interfering and may be used as $R^1$ or $R^2$.

The beta-thiodialkanol preferably contains only one sulfur atom per repeating unit, i.e., x is 1. However, it is acceptable and under some conditions desirable to have x at a value of 2 thereby having a disulfide structure in the molecule. It is also possible to have compositions where there are mixtures of monosulfide and disulfide. For an automatic transmission fluid, the monosulfide is desired. In lubricating oils for engines, some disulfide is desired to provide anti-wear as well as anti-oxidant properties.

The alcohol, ROH, is a monofunctional alcohol wherein R is a hydrocarbyl group. While R is stated to be hydrocarbyl, it is desirable that the hydrocarbyl group in this instance be limited to materials which do not react with the hydroxyl groups of the beta-thiodialkanol (I). If the group R contains moieties which would react with the beta-thiodialkanol, then cross-linking of the product is possible and such is not desired. The alcohol is preferably a primary alcohol with a further preference for branched alcohols. A particularly desirable group of materials as the alcohol (II) are the neo alcohols. In particular, a preferred alcohol is 2,2,4-trimethylpentanol. A second preferred alcohol is isobutyl alcohol. The alcohols can contain hetero atoms which are non interfering, such as esters, ethers, sulfides and tertiary amines.

A particular advantage of the compositions of the present invention is that they have excellent fluidity and low temperature blend viscosity properties through the use life of the product. That is, the compositions of the present invention are easily blended into an automatic transmission fluid due to the fluidity, and further do not separate under low temperature conditions. The choice of the alcohol aids in obtaining these properties.

Conveniently, R is an aliphatic group and contains from about 2 to about 30 carbon atoms, preferably from about 4 to about 28 carbon atoms and most preferably from about 6 to about 18 carbon atoms. Thus, R may be described as an alkanol.

To obtain the particular benefits of the present invention, the molar ratio of I:II (the beta-thiodialkanol to the alcohol) is maintained such that the molar ratio of the end product contains the respective materials at a 7:2 to about a 1:2 ratio. Preferably, the foregoing molar ratio is 5:2 to about 1:1.

The aromatic amines generally useful include phenylnaphthyl amines, alkylated phenylene diamines, quinolines, phenothiazine derivatives and preferably ring alkylated diphenylamines which are mono or dialkylates. Typically, the alkyl portion of the molecule has from 2 to 16 carbon atoms, preferably 4 to 12 carbon atoms per alkyl group. The dialkylates are preferred in the composition of the invention.

The alkylated diphenylamines may be prepared as follows.

EXAMPLE 1

A mixture of 169 grams (1.0 mol) of diphenylamine, 504 grams (4.0 mols) of a mixture of isomeric nonenes, 55 grams of Filtrol clay No. 22 and 1.5 grams of concentrated sulfuric acid was stirred for 4 hours at 185°-190° C. in a 0.5 gallon autoclave. The isomeric nonenes employed were derived from the polymerization of propylene, consisting predominantly of secondary olefins, the major portion being dimethyl heptenes, and the ratio of isomers containing internal to those containing terminal double bonds being approximately 2:1. The Filtrol clay No. 22 is an acid activated bleaching earth sold by the Filtrol Corporation having a particle size of 100% through 100 mesh, 90% through 200 mesh and 75% through 325 mesh, a particle density of 1.3 grams per cubic centimeter, a surface area (by nitrogen adsorption) of 275 square meters per gram, and having a chemical analysis on a volatile-free, oxide basis as follows: 70.9% $SiO_2$, 17% $Al_2O_3$, 3.9% $Fe_2O_3$, 3.2% MgO, 1.6% CaO, 2.0% $SO_3$, 1% $K_2O+Na_2O$, and 0.6% $TiO_2$.

During the reaction, the autogenous autoclave pressure was about 33 p.s.i.g. After the 4 hour reaction period a small sample (10% of the mixture) was taken, filtered, neutralized with anhydrous sodium carbonate and distilled to remove unreacted nonene. The residue was filtered and analyzed by infrared analysis and shown to contain 8.5% free diphenylamine. The alkylated portion consisted of a mixture of p-mono and p,p'-dinonylated diphenylamine. Forty-seven grams (0.45 mol) of styrene was added to the reaction mixture in the autoclave without distilling off excess nonene and stirred for 1 hour at 185°-190° C. at approx 200 KPa (33 p.s.i.g.) autogenous autoclave pressure. After cooling, the reaction mixture was filtered, 10 grams of anhydrous sodium carbonate was added to the filtrate and the filtrate was distilled up to 200° C. pot temperature to remove unreacted nonene. The mixture was then steam distilled at 130°-140° C. to remove olefin polymer. The dry distillation residue was filtered to remove inorganic salts and 344 grams of final product was obtained consisting of a yellow oil with a specific gravity of 0.95. Infrared analysis of the product showed a content of 3.7% nitrogen and 2.2% free diphenylamine. The average number of nonyl substituents per molecule of diphenylamine was 1.65.

EXAMPLE 2

A mixture of 169 grams (1.0 mol) diphenylamine, 392 grams (4.0 mols) of isomeric heptenes, 55 grams of the acid activated clay employed in Example 1, and 1.5 cubic centimeters of concentrated sulfuric acid was stirred for 4 hours at 185°-190° C. in 0.5 gallon autoclave; the autogenous pressure was 80-100 p.s.i.g. The isomeric heptenes employed consisted primarily of secondary heptenes and tertiary heptenes having internal double bonds. Analysis of a sample (10% of total mixture) after the initial four hour reaction period showed a content of unreacted diphenylamine of approximately 7%.

Forty-seven grams (0.45 mol) of styrene was added to the crude alkylate in the autoclave and stirred for one hour at 185°-190° C. at 75-80 p.s.i.g. autogenous autoclave pressure. After cooling, the reaction mixture was filtered, neutralized with anhydrous sodium carbonate and distilled up to 200° C. pot temperature to remove unreacted heptene after which it was stream distilled at 130°-135° C. to remove olefin polymer was then filtered.

Three hundred ten grams of heptylated, styrene scavenged diphenylamine was obtained. It was a clear, pale yellow oil. Analysis of the product using infrared absorption show that the product contained 2.15% free diphenylamine. The average number of heptyl substituents per molecule was 1.9.

EXAMPLE 3

A mixture of 169 grams (1 mol) of diphenylamine, 55 grams of the acid activated clay employed in Example 1, 1.4 milliliters of concentrated sulfuric acid, and 448 grams (4 mols) of isomeric octenes is heated and stirred for 4 hours at 185°-190° C. in an autoclave. The autogenous pressure during the reaction was approx. 60 p.s.i.g. The isomeric octenes employed consist predominantly of secondary octenes and tertiary octenes having internal double bonds.

The hot autoclave is vented through a condenser and most of the excess octene was distilled off. At this point the crude alkylate contained approx. 7% unreacted diphenylamine, and approx. 7% mono-tertiary butyl diphenylamine.

To the residue in the autoclave is added 224 grams (2 mols) of diisobutylene and stirring was again continued for 1 hour at 180°-185° C. under an autogenous pressure of approx. 60 p.s.i.g. The diisobutylene employed was obtained by the polymerization of isobutylene and consisted of approximately 75% 2,4,4,trimethyl pentent-1, 23% 2,4,4,trimethyl pentene-2 with about 2% of other octene isomers.

After cooling, the reaction mixture is filtered, neutralized with anhydrous sodium carbonate and distilled up to 200° C. pot temperature to remove residual unreacted octene and then steam distilled to distill off any olefin polymer. The warm product was dried by blowing with dry nitrogen and the sodium carbonate removed by filtration. 357.5 grams of a light brown colored liquid product was obtained containing 1.5% diphenylamine and 1.2% mono-tertiary butyl diphenylamine.

The alkylated diphenylamine or the hindered phenol and the aforedescribed reaction product are typically combined at a weight ratio of 10:1 to 1:10, preferably 6:1 to 1:6.

The materials of the present invention as previously stated are desirably utilized in lubricating compositions particularly in automatic transmission fluids.

The compositions, when employed in motor oil are conveniently used in a minor amount with a major amount of a base fluid. The base fluid for an aqueous base composition is simply water and such other components as are necessary for the desired functional aspects of the fluid. Where the desired end product is a lubricating oil or a transmission fluid, the base oil is typically hydrocarbon in nature. Disclosed below are typical hydrocarbon oils useful in configuration with the compositions of the present invention.

Unrefined, refined and rerefined oils (and mixtures of each with each other) of the type disclosed hereinabove can be used in the lubricants and functional fluids of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The synthetic lubricating oils useful herein include hydrocabon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 100, diphenyl ether of polyethylene glycol having a molecular weight of about 500-1000, diethyl ether of polypropylene glycol having a molecular weight of about 1000-±500, etc. or mono- and polycarboxylic esters thereof, for example, the acetic acid esters, mixed $C_3$-$C_8$ fatty acids esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy- or polyaryloxy-siloxane oils and silicate oils comprise another useful class of synthetic lubricants (e.g., tetraethyl silicate, tetraisopropyl silicate tetra(2-ethylhexyl)silicate, tetra-(4-methyl-hexyl)silicate, tetra-(p-tert-butylpehnyl)silicate, hexyl-4methyl-2-pentoxy)-disiloxane, poly(methyl)siloxanes, poly(methylphenyl)-siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Polyolefin oligomers are typically formed by the polymerization reaction of alpha-olefins. Nonalphaolefins may be oligomerized to give a synthetic oil within the present invention, however, the reactivity and availability of alpha-olefins at low cost dictates their selection as the source of the oligomer.

The polyolefin oligomer synthetic lubricating oils of interest in the present invention include hydrocarbon oils and halo-substituted hydrocarbon oils such as are obtained as the polymerized and interpolymerized olefins, e.g., oligomers, include the polybutylenes, polypropylenes, propylene-isobutylene copolymers, chlorinated polybutylenes, poly(1-hexenes), poly(1-octenes), poly(1-decenes), similar materials and mixtures thereof.

Typically, the oligomer is obtained from a monomer containing from about 6 to 18 carbon atoms. Most preferably, the monomer used to form the oligomer is decene, and preferably 1-decene. The nomenclature alpha-olefin is a trivial name and the IUPAC nomenclature of a 1-ene compound may be considered to have the same meaning within the present invention.

While it is not essential that the oligomer be formed from an alpha-olefin, such is desirable. The reason for forming the oligomer from an alpha-olefin is that branching will naturally occur at the points where the olefin monomers are joined together and any additional branching within the backbone of the olefin can provide too high a viscosity of the end oil. It is also desirable that the polymer formed from the alpha olefin be hydrogenated. The hydrogenation is conducted according to known practices. By hydrogenating, the polymer free radical attack on the allyic carbons remaining after polymerization is minimized.

The molecular weight of the oligomer typically averages from about 250 to about 1400, conveniently from about 280 to about 1200, preferably from about 300 to about 1100 and most preferably about 340 to about 520. The choice of molecular weight of the oligomer is largely dependent upon whether a viscosity improver is included within the formulation. That is, the polyolefin oligomer, may require either a thickening or a thinning effect to ensure that the proper lubricating viscosities are maintained under extreme heat and cold conditions. Additional useful materials include alkylated aromatics. Preferably, the aromatic nucleus of the alkylated aromatic compound is benzene. A particularly useful synthetic lubricant is a mixture of the alpha olefin oligomer and the alkylated aromatic. Typically, a mixture of the oligomer to the alkylated aromatic will be at a weight ratio of about 8:1 to about 1:8.

Materials which may also be included herein are the natural oils. Natural oils include animal oils and vegetable oils (e.g., castor oil, lard oil) as well as the previously described oils.

Additional materials which are desirably added to the hydrocarbon based fluids are as follows: Viscosity improving materials may be included in the compositions of the present invention. The viscosity index improvers typically include polymerized and copolymerized alkyl methacrylates and mixed esters of styrene-maleic anhydride interpolymers reacted with nitrogen-containing compounds.

Polyisobutylene compounds are also typically used as viscosity index improvers. The amount of viscosity improver which may be typically added to the fully formulated automatic transmission fluid composition is about 1% to about 50%, preferably about 10% to about 25% by weight.

Zinc salts are also added to automatic transmission lubricants. Zinc salts are ordinarily utilized as extreme pressure agents such as zinc dithiophosphates. The zinc salts are added at levels measured by weight of the zinc metal at from about 0.02% to about 0.2%, preferably from about 0.04% to about 0.15% by weight.

Additional ingredients which may be included in a transmission fluid are fatty acid amides which are useful as additional friction modifiers, particularly for reducing the static coefficient of friction. Further useful components herein include seal swell agents such as sulfones and sulfolanes. Suitable seal swell agents are disclosed in U.S. Pat. No. 4,029,587 to Koch issued June 14, 1977. A still further useful component in the present invention is a foam suppression agent such as a silicon oil. Any other typical ingredient may be included herein such as pour point depressants, dyes, odorants and the like.

Additional components which are typically used in transmission fluids or hydraulic fluids include the following.

Extreme pressure agents and corrosion- and oxidation-inhibiting agent which may be included in the compositions of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diphepty phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di-(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned extreme pressure agents and corrosion-oxidation inhibitors also serve as anti-wear agents. Zinc dialkylphosphorodithioates are a well known example.

Anti-wear agents that are particularly useful in the hydraulic fluid compositions include those obtained from a phosphorus acid of the formula (RO)2PSSH, wherein each R is independently a hydrocarbon-based group, or the phosphorus acid precursors thereof with at least one phosphite of the formula $(R''O)_3P$, R'' is a hydrocarbon-based group, under reaction conditions at a temperature of about 50° C. to about 200° C. R is preferably an alkyl group of about 3 to about 50 carbon atoms, and R'' is preferably aromatic. The salt is preferably a zinc salt, but can be a mixed salt of at least one of said phosphorus acids and at least one carboxylic acid. These anti-wear agents are described more fully in U.S. Pat. No. 4,263,150, which is incorporated herein by reference. These anti-wear agents as well as the anti-wear agents referred to above can be provided in the hydraulic fluid compositions of the invention at levels of about 0.1% to about 5%, preferably about 0.25% to about 1% by weight based on the total weight of said fluid compositions.

The oxidation inhibitors that are particularly useful in the hydraulic fluid compositions of the invention are the hindered phenols (e.g., 2,6-di-(t-butyl)phenyl); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). These oxidation inhibitors as well as the oxidation inhibitors discussed above are preferably present in the hydraulic fluids of the invention at levels of about 0.05% to about 5%, more preferably about 0.25 to about 2% by weight based on the total weight of such compositions.

The rust-inhibitors that are particularly useful in the hydraulic fluid compositions of the invention are the alkenyl succinic acids, anhydrides and esters, preferably the tetrapropenyl succinic acids, acid/esters and mixtures thereof; metal (preferably calcium and barium) sulfonates; the amine phosphates; and the imidazolines. These rust-inhibitors are preferably present in the hydraulic fluids of the invention at levels of about 0.01% to about 5%, preferably about 0.02% to about 1% by weight based on the total weight of said fluids.

Pour point depressants may be included in the compositions described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. Publishers, Cleveland, Ohio 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655;479; 1,815,022; 2,191,498; 2,666,746; 2,721,877; 2,721,878 and 3,250,715 which are hereby incorporated by reference for their relevant disclosures.

Anti-foam agents are used to reduce or prevent the formation of stable form. Typical anti-foam agents include silicones or organic polymers. Additional anti-foam compositions are described in "Foam Control Agents", by Henry T. Kener (Noyes Data Corporation, 1976), pages 125–162.

UTILIZATION OF THE COMPOSITION

The composition of the present invention is typically used in the automatic transmission fluid, hydraulic fluid, functional fluid or lubricating oil composition at a level of from about 0.05% to about 10%, preferably from about 0.2% to about 5% by weight. As the products of the invention are oleophilic, the blending of the products is relatively simple. Where the compositions of the present invention are intended for use in an aqueous based material, it is desirable to include such adjuvants and other materials as may be necessary to stably disperse the active ingredients in the aqueous formulation. When an aqueous composition is utilized, it is typically up to 85% and preferably up to 90% water with the remainder being the active ingredient of this invention and other materials typically placed in such aqueous formulations.

The following are examples of the present invention.

EXAMPLE I

A product useful in the present invention is prepared by blending 2 moles of thiodiethanol and 2 moles of isobutyl alcohol in toluene. The amount of toluene as a solvent is 300 grams. The condensation reaction is conducted under reflux (100° C.–180° C.) in the presence of p-toluene sulfonic acid, at a level of about 0.05 moles. The reaction is continued until no more water is evolved. The catalyst is neutralized with sodium hydroxide (50% aqueous) and the solvent removed under reduced pressure. The mixture is filtered and the liquid product is recovered.

The above examples may be modified by using a mixture of primary amyl alcohol and isobutyl alcohol with the remaining conditions unchanged.

EXAMPLE II

To 4 parts of the composition of Example I are added 1 part of the alkylated diphenylamine of Example 2. The resulting composition is thoroughly mixed.

EXAMPLE III

The product of Example II is blended at a level of 0.5% into an automatic transmission fluid package. The remainder of the composition is substantially a base oil.

The product is tested for its oxidation stability through the use of the Turbo Hydromatic Transmission Oxidation Test. The product gives an excellent 9.3 rating for the forward clutch drum sludge versus a 5.5 rating for the same package utilizing a commercial sulfur containing inhibitor at the same sulfur level.

What is claimed is:

1. An oil-soluble composition of: (A) the reaction product of a beta-monothiodialkanol and a mononhydric alcohol wherein the beta-monothiodialkanol is terminated with the residue of the monohydric alcohol; and (B) an aromatic amine or a hindered phenol or mixtures thereof.

2. The composition of claim 1 wherein the beta-thiodialkanol is $$HOR^1(S)_xR^2OH \qquad I$$

where x is an integer of 1; $R^1$ and $R^2$ are each $—CHR^3CHR^4—$ radicals where $R^3$ and $R^4$ are hydrogen or hydrocarbyl.

3. The composition of claim 1 wherein the monohydric alcohol contains from 2 to about 30 carbon atoms.

4. The composition of claim 1 wherein the aromatic amine is an alkyl diphenylamine which contains from about 2 to about 16 carbon atoms in the alkyl portion.

5. The composition of claim 1 wherein the monohydric alcohol contains from about 4 to about 18 carbon atoms.

6. The composition of claim 1 wherein the aromatic amine is a dialkylated diphenylamine.

7. The composition of claim 1 wherein the beta-thiodialkanol is substituted with at least one aliphatic carbon atoms at either $R^3$ or $R^4$.

8. The composition of claim 1 wherein the alcohol is a primary alcohol.

9. The composition of claim 1 wherein the alcohol is a branched alcohol.

10. The composition of claim 1 wherein the monohydric alcohol is a neo alcohol.

11. A lubricating oil composition comprising a major amount of an oil of lubricating viscosity and a minor amount of the composition of claim 1.

12. An automatic transmission fluid containing a minor amount of the composition of claim 1.

13. A composition which is: (A) the hydrocarbyl terminated reaction product of a beta-thiodialkanol of the formula $$HOR^1(S)_xR^2OH \quad (I)$$

terminated with a monohydric alcohol of the formula $$ROH \quad II$$

wherein x is an integer of 1; $R^1$ and $R^2$ are each —$CHR^3CHR^4$— radicals where $R^3$ and $R^4$ are hydrogen or hydrocarbyl; R is a hydrocarbyl radical and the reaction is conducted such that the molar ratio of I:II in the reaction product is about 7:2 to about 1:2, and (B) an aromatic amine or a hindered phenol or mixtures thereof.

14. The composition of claim 13 wherein R contains from about 2 to about 30 carbon atoms.

15. The composition of claim 13 wherein ROH is an aliphatic alcohol.

16. The composition of claim 13 wherein the alkyl diphenylamine contains from about 2 to about 16 carbon atoms in the alkyl portion.

17. The composition of claim 13 wherein the aromatic amine is a dialkylated diphenylamine.

18. The composition of claim 13 wherein the molar ratio of I:II is about 5:2 to about 2:2.

19. The composition of claim 13 wherein $R^3$ and $R^4$ are both hydrogen.

20. The composition of claim 13 wherein the alkyl diphenylamine contains an alkyl group on each phenyl.

21. The composition of claim 13 wherein the alcohol is a primary alcohol.

22. The composition of claim 13 wherein R contains from about 4 to about 18 carbon atoms.

23. The composition of claim 13 wherein $R^3$ and $R^4$ are hydrocarbyl.

24. The composition of claim 13 wherein ROH is an alkanol.

25. The composition of claim 13 wherein at least one of $R^3$ and $R^4$ are methyl.

26. The composition of claim 13 wherein ROH is a neo alcohol.

27. The composition of claim 13 wherein ROH is a mixture of alcohols.

28. The composition of claim 13 wherein ROH is an aromatic alcohol.

29. The composition of claim 13 wherein x is 1; $R^3$ and $R^4$ are each hydrogen, and R contains from about 4 to about 18 carbon atoms.

30. A lubricating oil composition comprising a major amount of an oil of lubricating viscosity and a minor amount of the composition of claim 13.

31. An automatic transmission fluid containing a minor amount of the composition of claim 13.

32. The composition of claim 31 wherein x is 1, $R^3$ and $R^4$ are both hydrogen; and R contains from about 4 to about 18 carbon atoms.

33. The composition of claim 13 wherein I:II is 2:2.

34. A composition comprising of water and the reaction product of a beta-thiodialkanol and a monohydric alcohol wherein the beta-thiodialkanol is terminated with the residue of the monohydric alcohol.

35. The composition of claim 34 additionally containing an aromatic amine or a hindered phenol or mixtures thereof.

36. An aqueous composition comprising water and dispersed or dissolved in the water the hydrocarbyl terminated reaction product of a beta-thiodialkanol of the formula $HOR^1(S)_x(R^2)OH$ (I) which is terminated with a monohydric alcohol of the formula ROH (II) wherein x is an integer of 1; $R^1$ and $R^2$ are each —$CHR^3CHR^4$— radicals where $R^3$ and $R^4$ are hydrogen or hydrocarbyl; R is a hydrocarbyl radical and the reaction is conducted such that the molar ratio of I:II in the reaction product is about 7:2 to about 1:2.

37. The composition of claim 36 additionally comprising an aromatic amine or a hindered phenol or mixtures thereof.

* * * * *